United States Patent [19]

Whisnant

[11] Patent Number: 4,471,917

[45] Date of Patent: Sep. 18, 1984

[54] BALLOON-CONTROL GUIDE AND YARN REWINDING PROCESS

[75] Inventor: John K. Whisnant, Etowah, Tenn.

[73] Assignee: Celanese Corporation, New York, N.Y.

[21] Appl. No.: 399,945

[22] Filed: Jul. 20, 1982

[51] Int. Cl.[3] ..... B65H 75/00; B65H 57/00; D03J 5/08

[52] U.S. Cl. ..... 242/54 R; 242/131.1; 242/157 R; 242/172; 57/354

[58] Field of Search ..... 242/128, 129.53, 129.6, 242/129.72, 130–131.1, 137, 172, 157 R, 54 R; 57/352, 354, 356, 357; 28/190; 248/481, 663; 403/68, 76

[56] References Cited

U.S. PATENT DOCUMENTS

| | | | |
|---|---|---|---|
| 1,779,057 | 10/1930 | Tolmach | 403/68 |
| 2,112,656 | 3/1938 | Ponce | 248/481 |
| 2,429,798 | 10/1947 | Bradnack et al. | 242/131 |
| 2,534,339 | 12/1950 | Chaya et al. | 242/131 |
| 3,421,706 | 1/1969 | Herubel | 242/54.4 |
| 4,298,174 | 11/1981 | Kovaleski | 242/128 |

FOREIGN PATENT DOCUMENTS

| | | | |
|---|---|---|---|
| 943461 | 3/1949 | France | 242/137.1 |

*Primary Examiner*—Leonard D. Christian
*Attorney, Agent, or Firm*—Robert J. Blanke

[57] ABSTRACT

An improved balloon-control guide for use in end-unwinding packages of crosswound filamentary yarn. The guide comprises self-centering means for permitting the guide to self-center, under yarn balloon forces, towards an axis representing the yarn balloon's energy center at any point in time. Use of the guide, in otherwise conventional beaming operations, results in significant increase in productivity.

8 Claims, 17 Drawing Figures

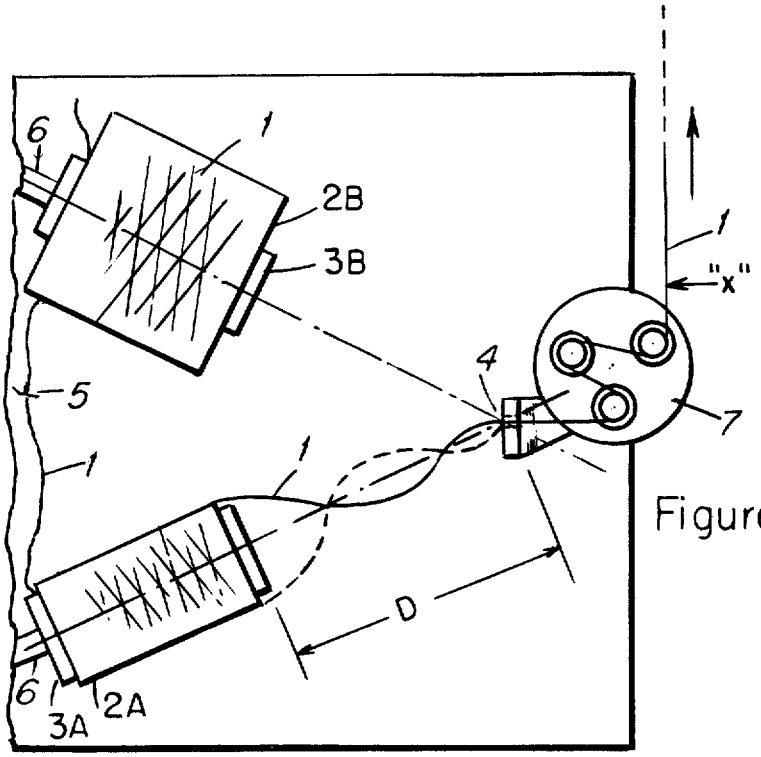
Figure 2A
Figure 2B
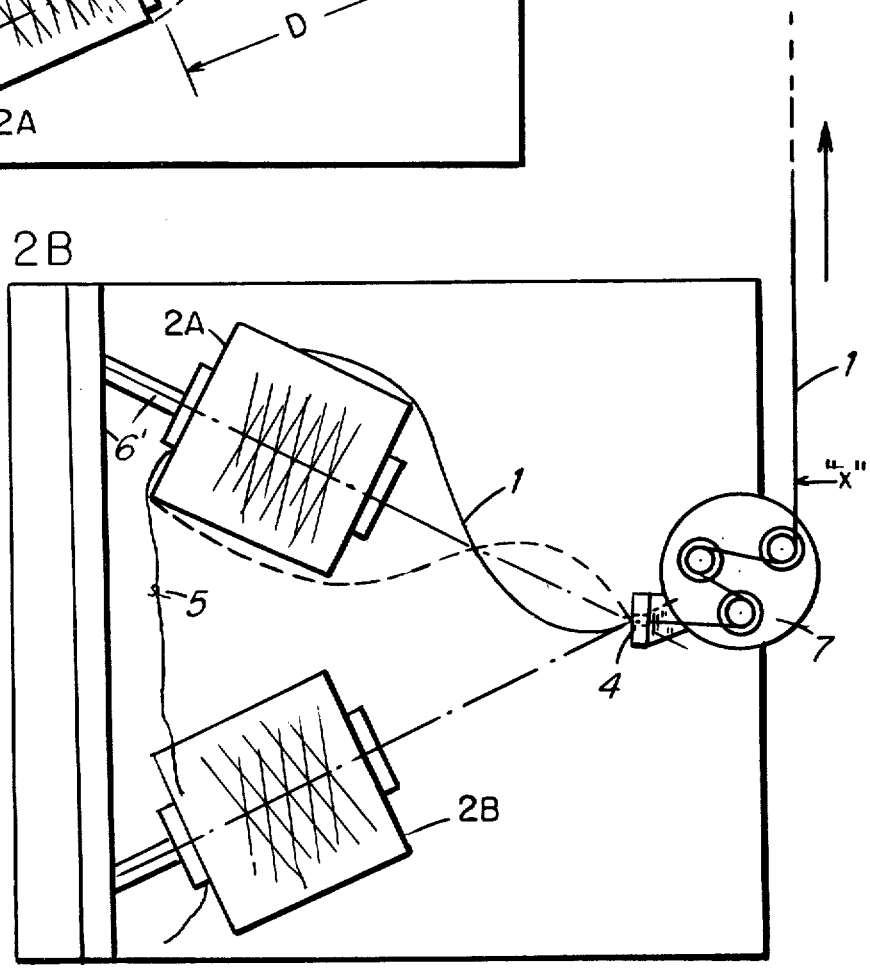

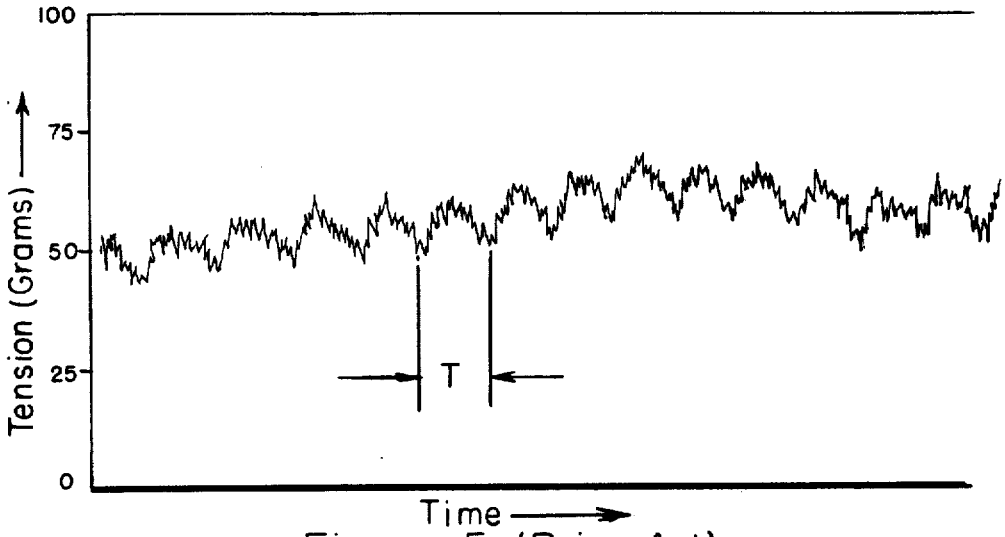
Figure 5 (Prior Art)
Figure 4B
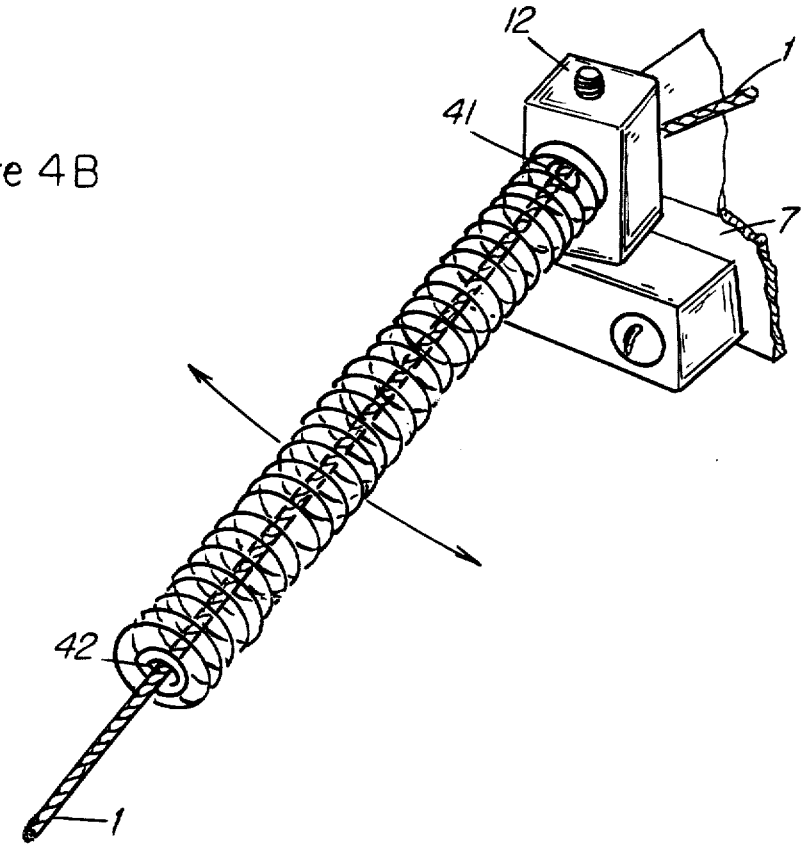

Figure 7C
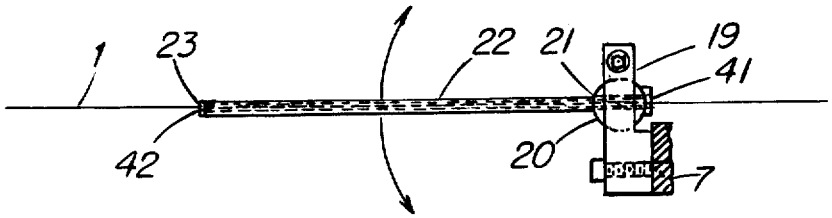
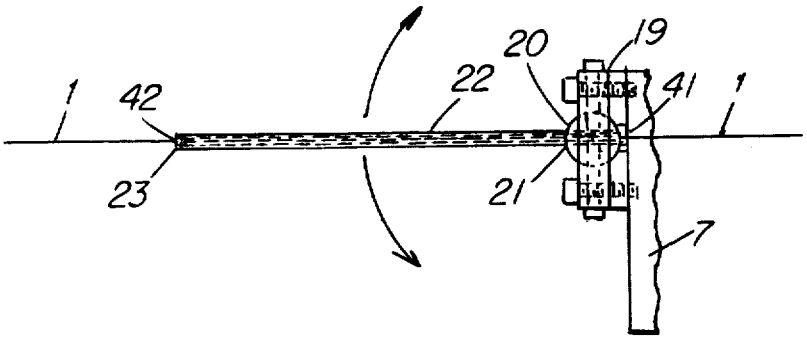
Figure 7D

BALLOON-CONTROL GUIDE AND YARN REWINDING PROCESS

BACKGROUND (i) Field of the Invention

This invention relates generally to creels for end-unwinding filamentary yarn from cross wound packages in, for example, rewinding processes such as beaming. More particularly, it concerns an improved balloon-control guide in random creels involving the unwinding from numerous large packages of yarn at high speeds. The guide permits lower and more uniform yarn winding tensions; and thereby improves quality of the beamed yarn and reduces processing problems.

(ii) Prior Art

Beaming of filamentary yarn is extremely old. For example, U.S. Pat. No. 3,648,338, FIG. 1, shows a creel involving side-unwinding. End-unwinding yarn from packages by means of balloon-control fixed position guides in beaming operations is also very old. For example, see Example 1 (Comparative) below. However, many beaming processes today operate at well below 1000 ypm (yards/minute) even though the beaming machines are capable of speeds well in excess of 2000 ypm.

The use of a pivoted package and guide in a random creel is shown in U.S. Pat. No. 3,935,698 (Lesnik), FIG. 1. However, Lesnik essentially relates to a cabling process (in which a sheath yarn is wrapped around a core yarn) and the core yarn is unwound at high tension. Further, the pivoted balloon-control guide assembly has significant inertia since it supports the package of sheath yarn.

The use of heavy twin-position balloon-control guides is shown in U.S. Pat. Nos. 3,321,151 and 2,774,548 for unreeling spools of wire.

Essentially, nowhere does the prior art appear to show satisfactory apparatus and method for end-unwinding yarn from large packages at the low and uniform tensions and high speeds desirable in efficient beaming operations.

SUMMARY OF THE INVENTION

In contrast to the forementioned prior art there has now been found an improved apparatus of the type for beaming filamentary yarn from feedstock packages, the packages comprising feedstock filamentary yarn wrapped around the exterior face of a bobbin, which apparatus comprises: (a) a creel for supporting at least a pair of stationary and approximately horizontally inclined feedstock packages, the first feedstock package being a running yarn package and the second feedstock package being a reserve yarn package tailed thereto; (b) a yarn take-up device for pulling the feedstock yarn from the feedstock packages in end-unwinding manner; and (c) a balloon-control guide for controlling the geometry of a balloon formed by end-unwinding the feedstock yarn from one or other of the pair of feedstock packages in alternating manner; wherein the improvement comprises: said balloon-control guide comprises self-centering means for permitting said guide to self-center, under yarn balloon forces, towards an axis representing said yarn balloon's energy center at any point in time.

The use of such a balloon-control guide in otherwise conventional beaming operations has permitted speeds to be increased from speeds, say, below 1000 ypm to speeds of 2,500 ypm for certain types of feedstock packages without introducing undesirably high average tensions or tension fluctuations.

BRIEF DESCRIPTION OF THE DRAWINGS

FIGS. 2A–2D are plan views corresponding to zone L1 of FIG. 1. They show some transient prior art yarn balloon configurations obtained with prior art yarn balloon-control guides.

FIGS. 4A–4C are perspective views of various self-centering balloon-control guides of the invention.

FIG. 5 is a tensometer chart of yarn tension obtained with prior art apparatus.

FIGS. 7C–7D are detailed drawings of another embodiment of the invention.

DESCRIPTION OF THE PREFERRED EMBODIMENTS

The following Examples and Comparative Examples together illustrate the advantages of the claimed invention over prior art apparatus and process.

Figure 1:
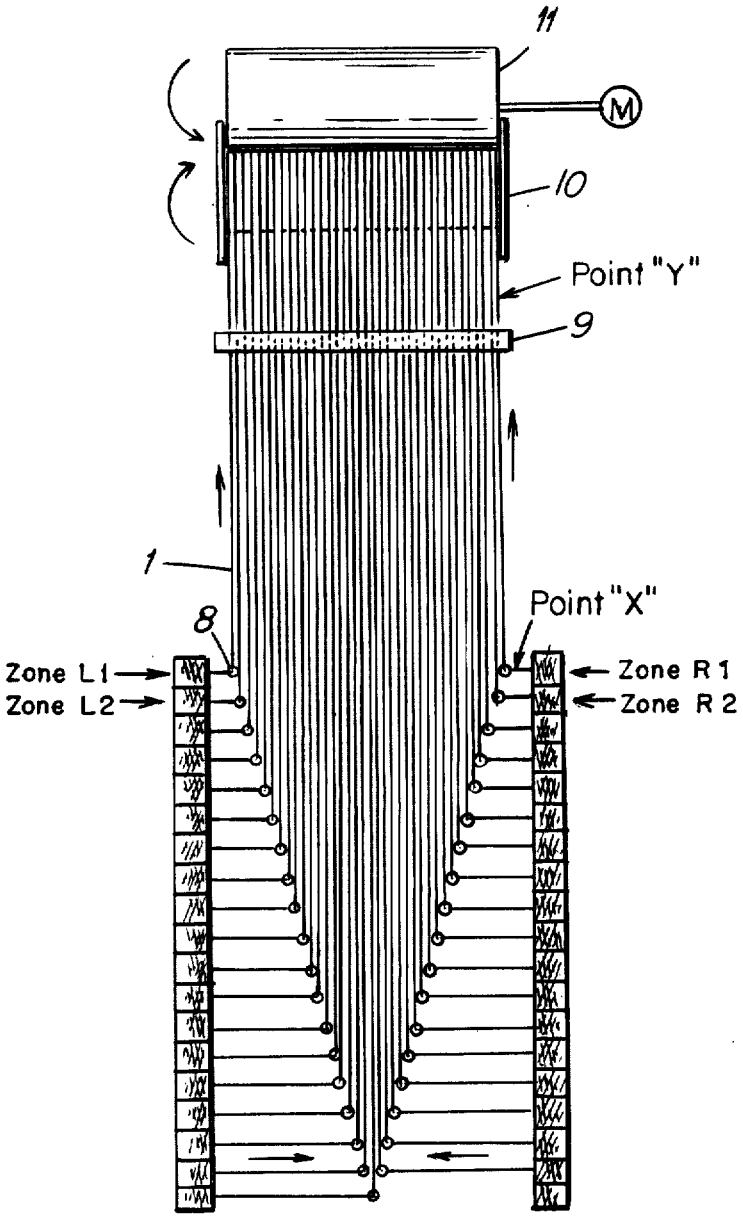
FIG. 1 is a simplified semi-schematic partial plan view of prior art beaming process and apparatus.

At the outset it should be noted that the semi-schematic FIG. 1 is applicable to both the prior art and the invention. This is because the heart of the invention lies in the use of novel apparatus within a schematic portion of FIG. 1 (in particular Zones L1, L2, R1, R2, etc).

FIG. 1 shows a plurality of yarn threadlines 1 being wound in parallel sheet form onto a beam 10. The beam is surface driven by a drive roll 11, which in turn is driven by a motor M. Each of the plurality of threadlines originates from a respective zone, such as zone L1, within a creel of feedstock packages of yarn. FIG. 1 shows two portions to the creel: a left-hand portion comprising zones L1, L2 etc; and a right-hand portion comprising zones R1, R2 etc. Various guides are positioned between the creel and the beam to ensure that the threadlines are essentially in parallel sheet form as they are wound onto the beam. As shown in FIG. 1, each of a plurality of eyelet guides 8 guides a respective threadline through a right angle. Likewise comb 9 having a plurality of guides is used to control the spacing between the threadlines and to ensure an even lay of threadlines onto the beam. In practice, of course, it will be appreciated that a large number of different guiding systems are possible, dependent particularly upon space and geometrical considerations as well as the desirability of winding all threadlines onto the beam at approximately equal average tension.

EXAMPLE 1 (COMPARATIVE)

A conventional prior art beaming process was operated in accordance with FIG. 1, FIGS. 2A–2D, and FIG. 5. FIG. 1 is a simplified semi-schematic partial plan view of a typical prior art beaming process and apparatus. FIGS. 2A–2D represent enlargements of zones such as zone L1, etc. of FIG. 1 under several different process conditions. FIG. 5 is a chart of yarn tension against time.

In operation, and with reference to FIG. 1 incorporating FIGS. 2A–2D, each of a plurality of continuous threadlines of filamentary yarn 1 was end unwound from a respective running yarn package 2A essentially horizontally supported by creel frame 6, each yarn package consisting of filamentary yarn 1 crosswound onto a tube 3A; each threadline being sequentially passed through a respective balloon-control guide 4 (in the form of a ceramic eyelet located at the point of intersection of the axes of the running yarn package and a reserve yarn package 2B whose outer yarn end is joined by a knot 5 to the inner yarn end of the running yarn package); through a respective conventional tension control device 7 (shown semi-schematically in FIGS. 2A–2D, but essentially identical to the commercially available Kidde model number 156,223 shown as 7 in FIG. 4A); through respective turning guide(s) shown, for simplicity, as a single turning guide 8; through a respective guide portion of a multiple guide in the form of a comb 9; and thence, with all threadlines being in parallel sheet form, onto a beam 10, driven by drive roll 11, which was driven in turn by a motor M.

The process was operated at a speed of 1000 ypm with anywhere from 132 to 190 threadlines being wound onto the beam of a commercially available McCoy/Ellison beaming machine, which machine was theoretically capable of operating at a speed of 2,300 ypm.

Each full package of yarn on the creel consisted of about 35 pounds of polyester tire cord yarn crosswound around a tube of length 14 inches and outside diameter 6 inches. Each full package typically had a diameter of 13–14 inches. The polyester tire cord was an interlaced continuous multifilament yarn having a total denier of about 1,000 and formed from 192 filaments. The yarn typically had a yarn to metal coefficient of friction of about 0.5 on polished chrome.

The type of creel shown in FIGS. 2A–2D is a so-called "random creel". This is because threadline transfers from empty packages to full packages occur randomly from threadline to threadline, rather than simultaneously on all threadlines. A random creel is often preferred because it theoretically permits continuous operation rather than continual operation during the winding of a beam. However, in operation with the relatively large packages of yarn, the time utilization of the beam was found to be only 20–30 percent. It will be appreciated that stoppage of the beam is required whenever faults in any threadline are detected, either visually or by means of an automatic fault detector.

Observation of the balloons from each running yarn package indicated that the balloon was very unstable. It should be noted that, since the axis of the package of the material being unwound as well as its back-up transfer package must always line up with the withdrawal guide, this guide of necessity in conventional creel design is located 10 inches to 20 inches away from the head of the yarn package. Since the diameter of the yarn package being unwound continually changes in diameter by a ratio of 2 or 3:1, the rotational speed of the yarn ballooning around the package also changes by this ratio even though the linear speed of the unwinding yarn remains constant. With these constantly changing unwinding conditions, yarn ballooning around the package goes through a number of geometric changes which greatly affect the instantaneous tension in the yarn strands with tensions going from 0 to 100 grams or more in a time of a few milliseconds as the balloon changes from a single large one to more or to two or even three small ones, thus producing widely varying tensions in the individual yarn strands. FIG. 2A shows a primary package with yarn drawn from near the smallest diameter of the package where, with the rotational speed of the yarn increasing as the package diameter decreases, the balloon collapses and reforms into multiple balloons causing widely varying tensions in the strand. When the primary yarn is depleted and unwinding is transferred to the full reserve package, the rotational speed of the balloon decreases and usually forms a single large balloon which also collapses erratically, resulting in widely fluctuating tensions in the running threadline (as shown in FIG. 2B). Instantaneous tension variability occuring as a result of balloon collapse and reformation are not just increased by downstream friction points but are products of multiplication of other friction points; hence the primary point of good tension control is the stability of the unwinding yarn balloon.

Figure 2C:
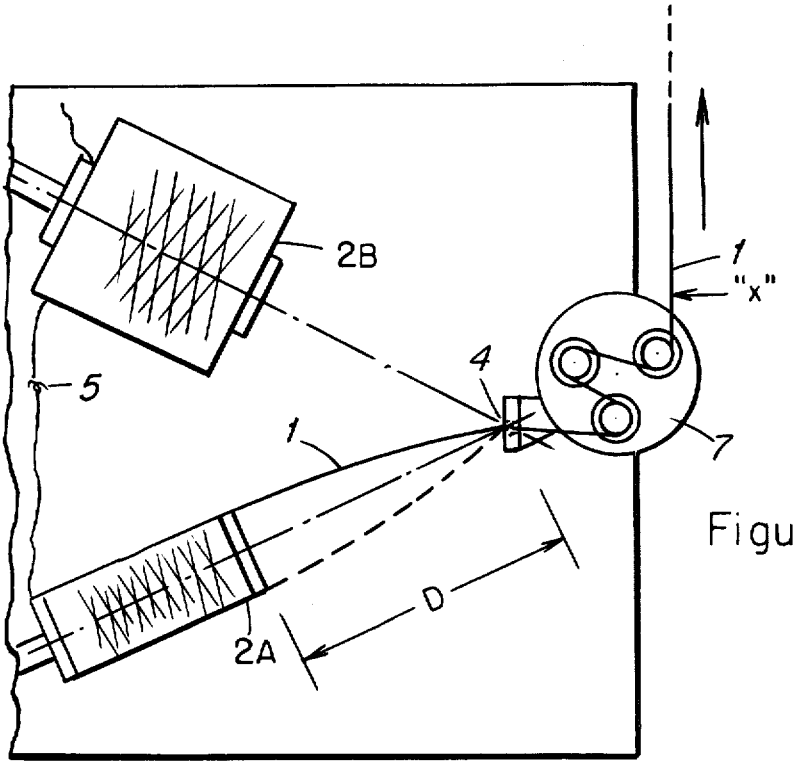
Figure 2D:
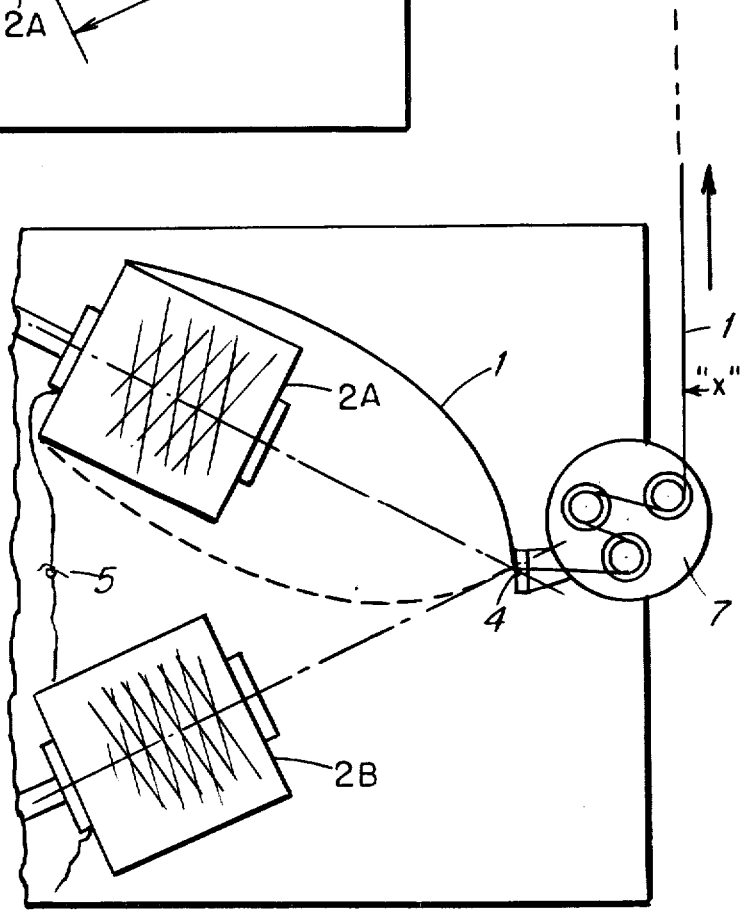

The type of balloon configuration shown in FIGS. 2C and 2D was never observed during these trials at 1000 ypm, although perhaps theoretically possible on a short term transient basis.

FIG. 5 is a typical tensometer chart of yarn tension obtained in this example. The tension was measured just downstream of the triple disc tensioning device at point "X" shown in FIG. 1 and FIG. 2A, by means of a high speed electronic recording tensometer. Adjustment of the triple pairs of discs tensioning device immediately downstream of the balloon control guide did not materially improve the foregoing tension chart. The interval marked "T" along the time axis of FIG. 5 was found to correspond to one revolution of the balloon. It will be noted that the threadline tension was both high and highly variable. Average tension of the threadline at point "Y" in FIG. 1 was typically between 0.25 and 0.50 gpd.

When the foregoing process was operated at speeds below 700 ypm, instead of 1000 ypm, the time utilization was somewhat better at around 40 percent rather than 30 percent, but of course the overall beaming capacity was reduced.

Essentially, with the foregoing apparatus, major problems have been found to occur in unwinding yarns from large diameter packages at speeds in excess of 700 ypm, regardless of the yarn denier.

EXAMPLE 2

Example 1 was repeated except that a composit "self-centering" yarn balloon-control guidance system was used instead of the fixed guide 4 in FIGS. 2A–2D.

Figure 3A:
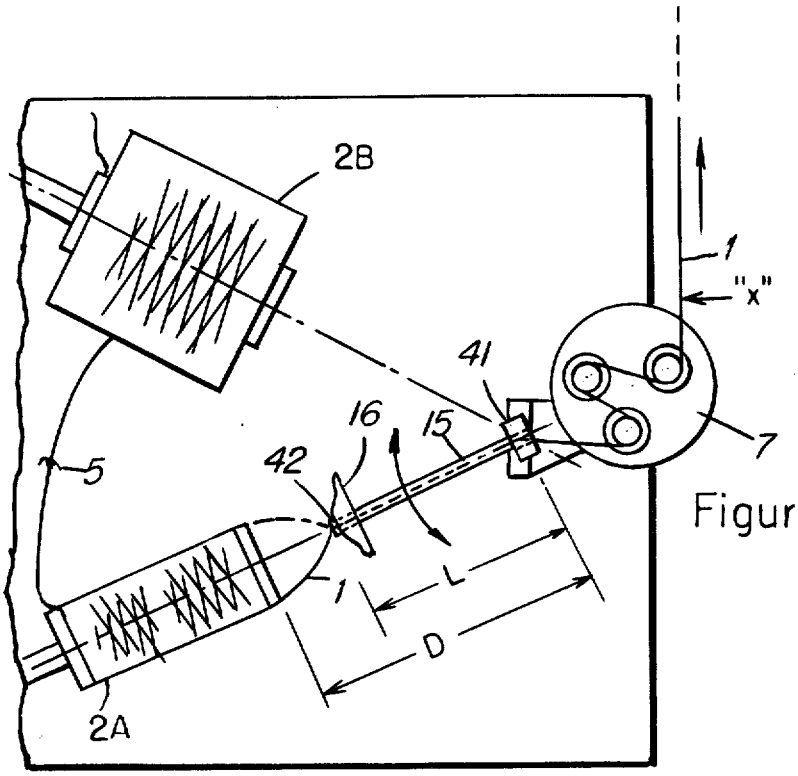
FIGS. 3A–3B are plan views of yarn balloon configurations obtained with the invention.
Figure 3B:
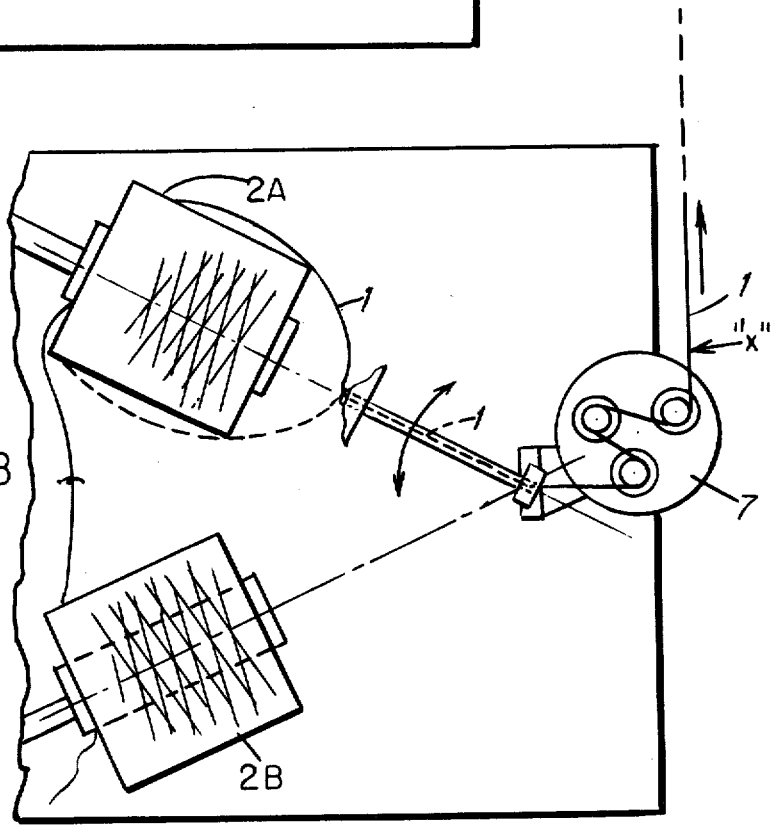
Figure 4A:
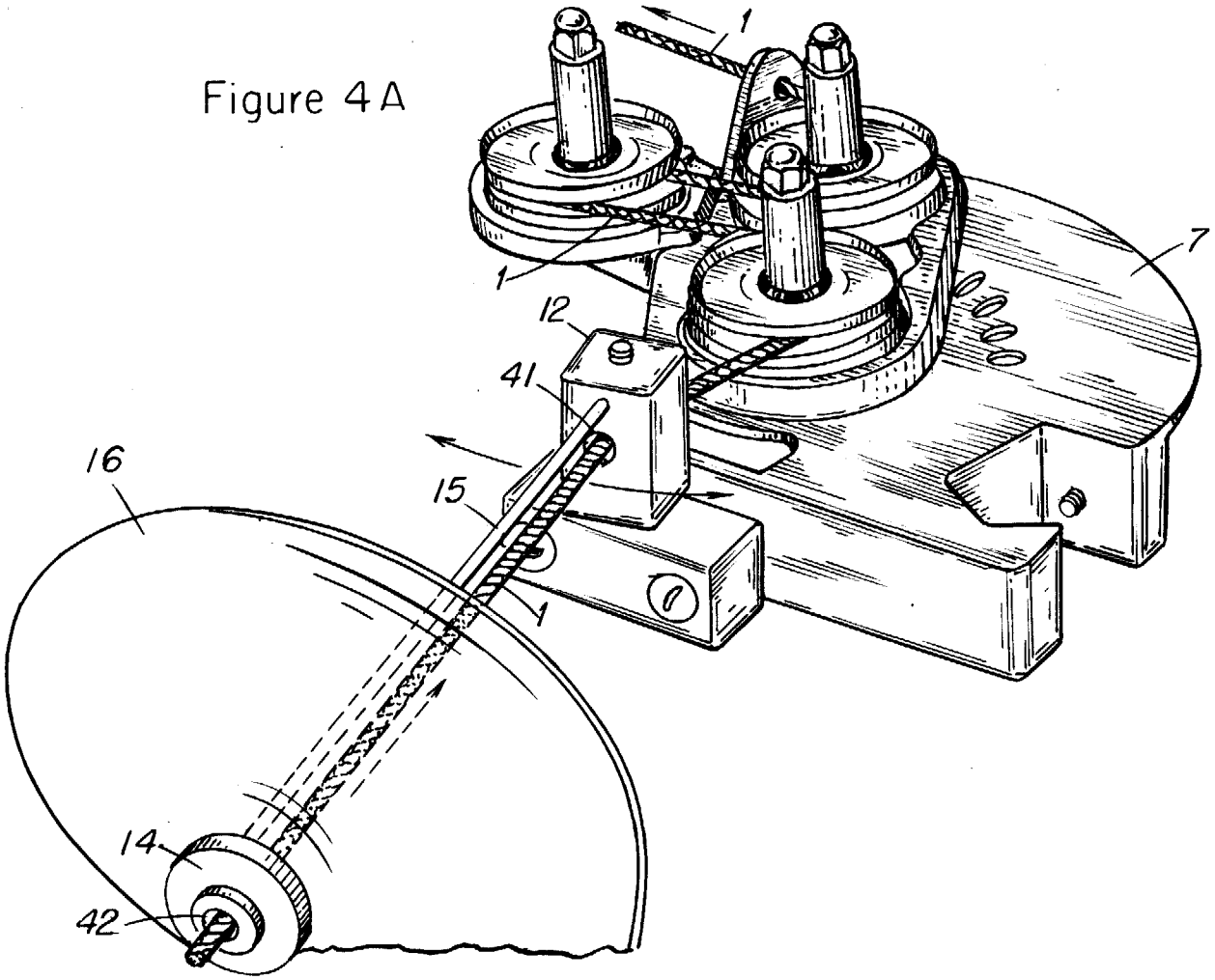
Figure 6A:
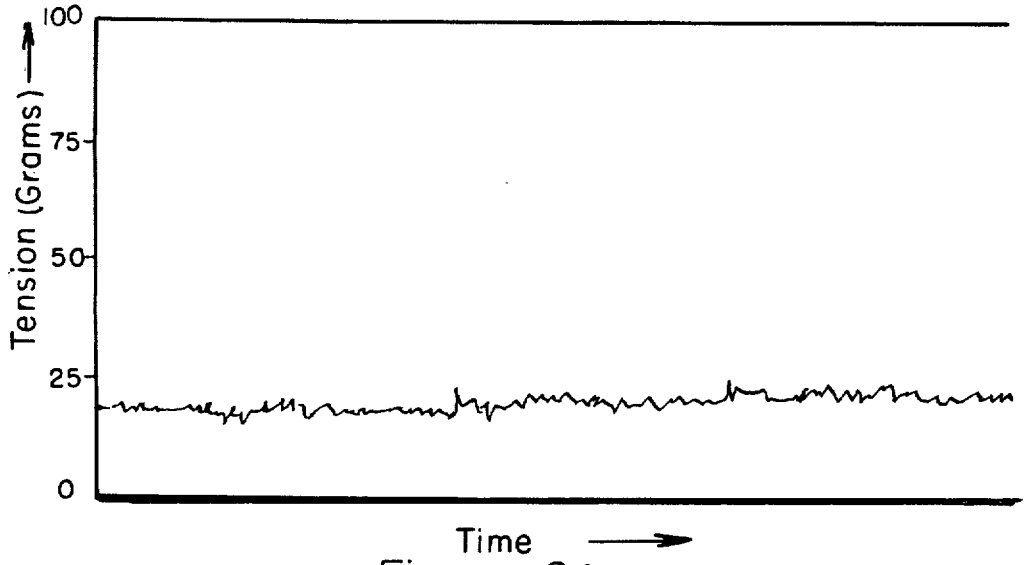
FIG. 6A–6B are tensometer charts of yarn tension obtained with the invention.
Figure 6B:
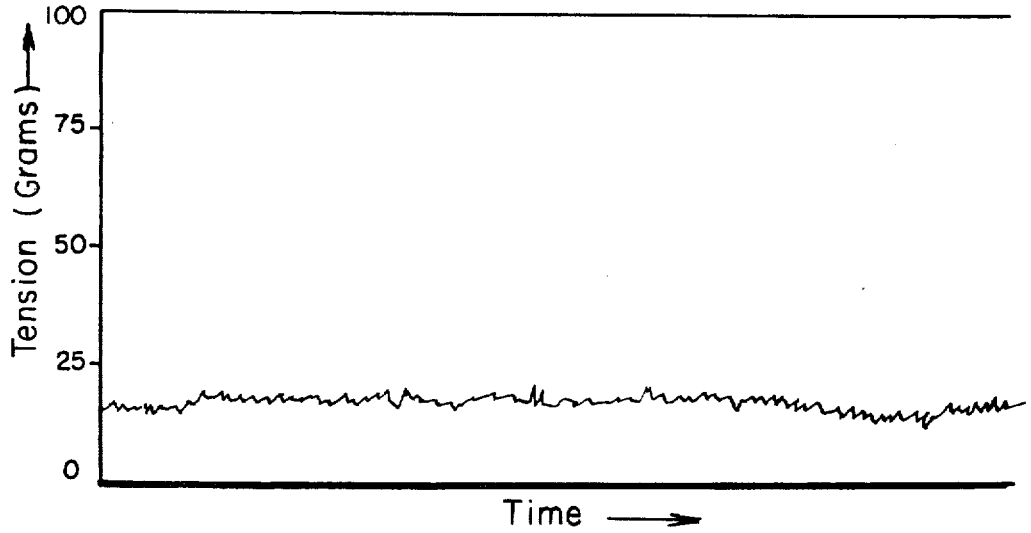
Figure 7A:
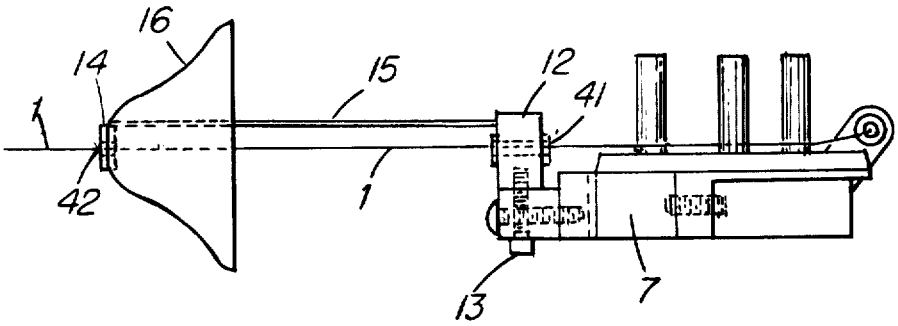
FIGS. 7A–7B are detailed drawings corresponding to FIG. 4A.
Figure 7B:
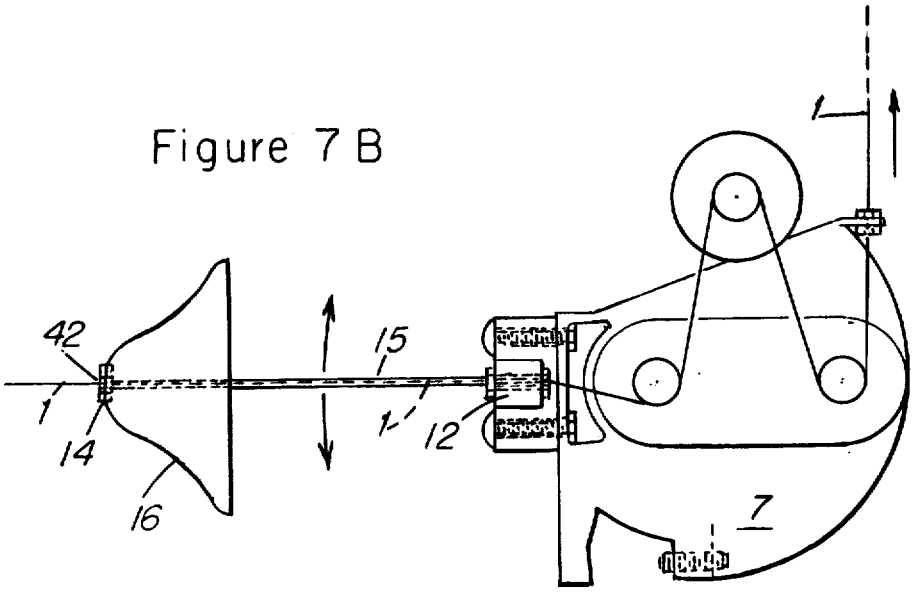

FIG. 4A is a perspective view of this self-centering guidance system, mounted against the Kidde tension controller, in combination with a threadline of yarn passing therethrough. FIGS. 7A and 7B are simplified elevation and plan views, respectively, of FIG. 4A. FIGS. 3A and 3B show the self-centering system within zones such as zone L1 of FIG. 1, and yarn balloon configurations typically and consistently obtained. FIG. 6A is a typical graph of threadline tension measured at point "X" in FIGS. 3A and 3B. FIG. 6B corresponds to FIG. 6A, except that the threadline speed was 750 ypm instead of 1000 ypm.

The self-centering guidance system is shown in FIGS. 7A, 7B, 4A and 3A and 3B. It comprises a pair of aligned eyelet guides 41 and 42, the guides being pivoted about a vertical axis through approximately the center of eyelet guide 41. Each guide is formed from a conventional ceramic material and has an internal diameter of ⅛ inch. Guide 41 is mounted in a housing 12 which housing is freely rotatable about pivot pin 13. Eyelet guide 42 is mounted in annular plate 14, which plate is connected to housing 12 by means of steel rod 15 having a length of 5 inches and diameter of 1/16 inch. A molded frustoconical shield of thin transparent plastic, 16, is glued around the annular plate 14. The shield has a diameter of 4 inches. The whole self-centering guidance system has a mass of less than 4 ounces.

The distance D in FIGS. 3A and 3B was equal to the distance D in FIGS. 2A-2D, at about 20 inches. Accordingly, the distance from eyelet guide 42 to the running yarn package 2A was about 13 inches.

FIGS. 3A and 3B show typical yarn balloon configurations that were consistently obtained with this yarn guidance system. Essentially, there was no tendency for the yarn balloon to collapse, and multiple balloons were not formed. Eyelet guide 42 self-centered at the energy center of the balloon and there was smooth transition at threadline changeover from an empty package of small diameter to a full package of large diameter.

FIG. 6A is a typical graph of threadline tension measured at point X in FIGS. 3A and 3B. It will be noted that both the average threadline tension and variability in tension were dramatically reduced as compared with Example 1 and FIG. 5. It was also found that use of the invention resulted in a significant increase in percent time utilization of the beaming equipment from below 30 percent with conventional equipment to over 60 percent with the invention. Average threadline tension at point "Y" in FIG. 1 was about 0.175 gpd.

When the process was operated at 750 ypm instead of 1000 ypm, typical threadline tensions corresponded to those shown in FIG. 6B.

Accordingly, use of this invention resulted in significant effective increase in beaming capacity and reduced the labor requirement per pound of beamed product.

EXAMPLE 3

Example 2 was repeated at 1000 ypm, except that shield 16 was omitted. There was a marked tendency for the yarn to snag around plate 14 during use.

Also, when Example 2 was repeated at 1000 ypm, except that shield 16 had a diameter of 3 inches rather than 4 inches, runnability was not as good on account of occasional tendency for the yarn to snag around the shield.

EXAMPLE 4

Example 2 was repeated except that the self-centering balloon-control guide was in the form of a lightweight coiled spring as shown in perspective in FIG. 4B. The commercially available spring 17 was made from 28-30 gauge wire and the threadline passed through the middle of the spring. The results were far less satisfactory than in Example 2. Essentially, the cantilevered spring that was used tended to sag and displace eyelet 42 downwardly from the energy center of the balloon. However, it is believed that a suitable satisfactory spring could be designed.

EXAMPLE 5

Figure 4C:
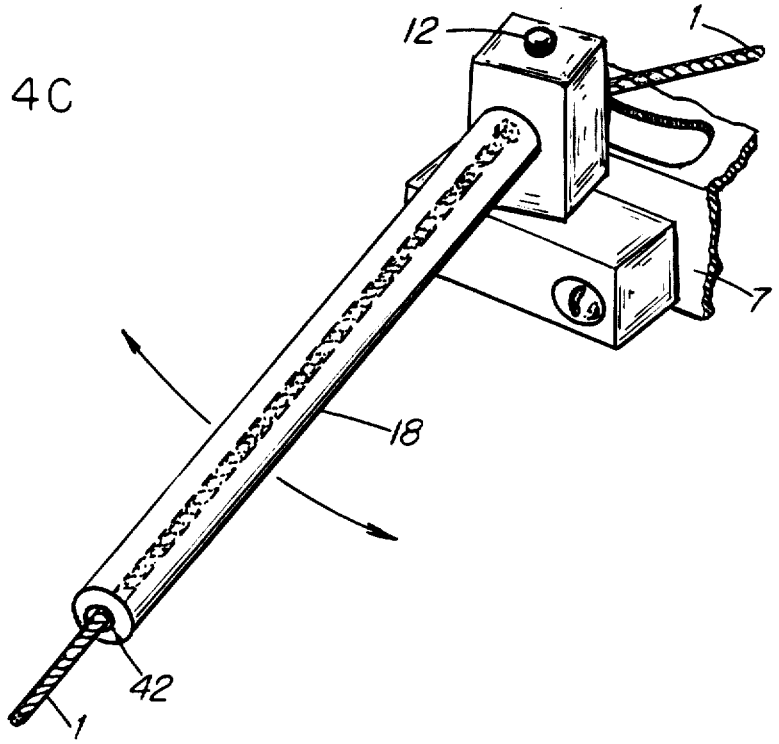

Example 2 was repeated except that the balloon-control guide had a solid tubular shape from its entry end to its exit as shown in FIG. 4C. The metal tube 18 had an outside diameter of 3/16 inch and inside diameter of ⅛ inch. This Example resulted in higher tension fluctuations than those obtained in Example 2, apparently because of the high inertia of the system. However, the inertia could obviously be greatly reduced by appropriate design.

EXAMPLE 6

This Example illustrates the possible use of a ball and socket joint pivot in the invention. It is shown in FIGS. 7C and 7D in side elevation and plan respectively. Essentially such a self-centering guidance system consists of a conventional socket housing 19 around a ball 20 containing an orifice 21 for supporting eyelet guide 41 in combination with long tube 22 containing orifice 23, which is aligned with orifice 21 and provides support for holding eyelet guide 42. The tube and ball can be molded out of plastic material as a single unit with, for example, the ball having a diameter of ⅜ inch and the tube a wall thickness of 1/32 inch or less, and an outer diameter of 5/32 inch. It will be noted that the projecting portion of eyelet 41 can also serve as a stop if so desired.

EXAMPLE 7

Yarn was unwound from a single package as in Example 2, except that instead of taking the yarn onto a beam, it was passed around a roll rotating at 3,000 ypm and passed through a suction gun to waste. The yarn balloon had excellent stability. This is believed to demonstrate that use of the apparatus of the invention will permit extremely high unwinding speeds to be used. In fact, it now appears that yarn beamers should be made to run at higher speeds, in order to take advantage of the instant invention.

The invention is illustrated by the foregoing Examples, but is not limited thereto. In practicing the invention, it is clear that virtually any other yarn such as nylon yarn, polypropylene yarn could be used instead of polyester yarn. Likewise, the apparatus of the invention could be used in any rewinding process involving end-unwinding, and is not limited to use in a beaming operation. Also, the process could involve the use of feedstock packages in the form of cones. Monofilaments could be used instead of multifilament yarn.

In practicing the process of the invention it is preferred that the average rewinding tension of the yarn be less than 0.2 gpd. It is also preferred that the yarn takeup device be rotated at a speed greater than 1500 ypm; more preferably greater than 2000 ypm; and most preferably greater than 2500 ypm. It is also preferred that the feedstock package comprises polyester yarn having total denier within the range 800 to 3000, cross-wound around a tubular bobbin having a diameter within a range from 2 to 10 inches, the package having an initial weight within the range 5 to 50 pounds. High quality yarns in textile denier, 20-70; may be used in the invention.

In the apparatus of the invention it is preferred that the self-centering guide be pivotable about at least a vertical axis. It is more preferred that the pivot be in the form of a ball and socket joint. It is preferred that the distance from the guide's entry end to the guide's exit end be more than 2 inches and less than 7 inches. When a shield is used around the guide's entry end, it is preferred that the shield has a diameter of at least 3 inches. When the balloon-control guide comprises a coiled spring, it is preferred that the spring has a diameter of less than half an inch. It is preferred that the balloon-control guide's angular moment of inertia about the pivot is less than 16 ounce inches; and most preferably far less than 16 ounce inches.

What I claim is:

1. An improved process for rewinding filamentary yarn from feedstock packages onto a yarn take-up device, the packages comprising feedstock filamentary yarn wrapped around the exterior face of a bobbin, which process comprises: (a) supporting at least a pair of stationary and approximately horizontally inclined feedstock packages on a creel; the first feedstock package being a running yarn package, and the second feedstock package being a reserve yarn package tailed thereto; (b) pulling the feedstock yarn from the feedstock packages in end-unwinding manner via a balloon-control guide and yarn tension control means, said yarn take-up device being such as a driven rotatable beam; and (c) preventing the formation of multiple balloons and controlling the geometry of a yarn balloon formed by end-unwinding the feedstock yarn from one or other of the pair of feedstock packages in alternating manner by means of a balloon-control guide; wherein the improvement comprises: controlling the yarn tension variation developed by ballooning of the yarn as it unwinds from said packages by passing said yarn being withdrawn from said package through a pair of axially aligned annular guide means in spaced apart relationship to each other forming said balloon control guide to thereby stabilize said yarn passing through said guide between the unwinding package and the first yarn tension control means, permitting said balloon-control guide to self-center, under yarn balloon forces, toward an axis representing said yarn balloon's energy center at any point in time.

2. The process of claim 1 which comprises rotating said yarn take-up device at a speed greater than 750 yards per minute.

3. The process of claim 1 which comprises rotating said yarn take up device at a speed greater than 1000 yards per minute.

4. The process of claim 1 which comprises rotating said yarn take-up device at a speed greater than 1500 yards per minute.

5. The process of claim 1 which comprises rotating said yarn take-up device at a speed greater than 2000 yards per minute.

6. The process of claim 1 which comprises rotating said yarn take-up device at a speed greater than 2500 yards per minute.

7. The process of claim 1 which comprises rewinding said yarn onto a beam at an average tension of less than 0.2 grams per denier.

8. The process of claim 1 which comprises rewinding a feedstock package of polyester yarn having a denier within the range 800 to 3000, cross-wound around a tubular bobbin having a diameter within a range from 2 to 10 inches, the package having an initial weight within a range from 5 to 50 pounds.

* * * * *